United States Patent [19]

Ernsthausen

[11] Patent Number: 4,794,308

[45] **Date of Patent: * Dec. 27, 1988**

[54] MULTIPLE GASEOUS DISCHARGE DISPLAY/MEMORY PANEL HAVING IMPROVED OPERATING LIFE

[75] Inventor: Roger E. Ernsthausen, Luckey, Ohio

[73] Assignee: Owens-Illinois Television Products Inc., Toledo, Ohio

[ * ] Notice: The portion of the term of this patent subsequent to Mar. 15, 2005 has been disclaimed.

[21] Appl. No.: 56,292

[22] Filed: May 29, 1987

Related U.S. Application Data

[63] Continuation of Ser. No. 385,973, Aug. 6, 1973, abandoned, which is a continuation of Ser. No. 61,842, Aug. 6, 1970, abandoned.

[51] Int. Cl.[4] ..... H01J 17/49

[52] U.S. Cl. ..... 313/587; 313/586; 313/635; 315/169.4; 427/108

[58] Field of Search ..... 313/586, 587, 590, 635, 313/581, 582; 315/169.4; 427/108; 428/203, 209

[56] References Cited

U.S. PATENT DOCUMENTS

| | | | |
|---|---|---|---|
| 2,020,727 | 11/1935 | Gaidies et al. | 176/126 |
| 2,103,227 | 12/1937 | Druyvesteyn | 176/122 |
| 2,104,073 | 1/1938 | Druyvesteyn et al. | 176/122 |
| 2,141,905 | 12/1938 | Fonda et al. | 134/47 |
| 2,171,227 | 8/1939 | Schreinemachers | 250/174 |
| 2,205,809 | 6/1940 | Breadner et al. | 176/122 |
| 2,207,174 | 7/1940 | Jenkins | 176/122 |
| 2,213,796 | 9/1940 | Zecher et al. | 176/122 |
| 2,238,784 | 4/1941 | Scott et al. | 176/122 |
| 2,249,672 | 7/1941 | Spanner | 176/126 |
| 2,295,626 | 9/1942 | Beese | 176/122 |
| 2,303,563 | 12/1942 | Law | 117/335 CP |
| 2,574,356 | 11/1951 | Sommer | 316/20 |
| 2,622,221 | 12/1952 | Beese | 313/109 |
| 2,644,113 | 6/1953 | Etzkorn | 315/228 |
| 2,648,752 | 8/1953 | Saunders | 219/19 |
| 2,708,726 | 5/1955 | Atherton | 313/103 |
| 2,716,190 | 8/1955 | Baker | 750/33.63 |
| 2,722,491 | 11/1955 | Anderson | 117/231 |
| 2,762,943 | 9/1956 | Mayer | 313/92 |
| 2,802,127 | 8/1957 | Dobischek et al. | 313/103 |
| 2,806,970 | 9/1957 | Meister et al. | 313/109 |
| 2,825,687 | 3/1958 | Preston et al. | 204/192 |
| 2,862,126 | 11/1958 | Ploke et al. | 313/66 |
| 2,894,858 | 7/1959 | Lytle | 117/211 |
| 2,919,361 | 12/1959 | Tschakert | 313/54 |
| 2,922,906 | 1/1960 | Day, Jr. et al. | 313/65 |
| 2,922,907 | 1/1960 | Hannam | 313/68 |
| 2,933,648 | 8/1956 | Bentley | 315/169 |
| 2,934,683 | 4/1960 | Durst et al. | 317/234 |
| 2,960,617 | 11/1960 | Lodge et al. | 313/89 |

(List continued on next page.)

FOREIGN PATENT DOCUMENTS

| | | |
|---|---|---|
| 1928526 | 1/1970 | Fed. Rep. of Germany . |
| 691795 | 5/1953 | United Kingdom . |
| 1188015 | 4/1970 | United Kingdom . |

OTHER PUBLICATIONS

IBM Technical Disclosure Bulletin, vol. 12, No. 10, Mar. 1970, pp. 1552 and 1553.

The Development of a Multicolor Plasma Disply Panel, E. Stredde, Coordinated Science Laboratory, Report R-370, Nov. 1967.

*Primary Examiner*—David K. Moore
*Assistant Examiner*—K. Wieder
*Attorney, Agent, or Firm*—John C. Smith, Jr.

[57] ABSTRACT

There is disclosed a multiple gaseous discharge display/memory panel having an electrical memory and capable of producing a visual display, the panel being characterized by an ionizable gaseous medium in a gas chamber formed by a pair of opposed dielectric material charge storage members which are respectively backed by a series of parallel-like conductor (electrode) members, the conductor members behind each dielectric material member being transversely oriented with respect to the conductor member behind the opposing dielectric material member so as to define a plurality of discrete discharge volumes constituting a discharge unit, the surface of the dielectric material having at least one oxide of Al, Ti, Zr, Hf, and Si applied thereto in an amount sufficient to provide stable panel operating voltages which do not significantly change with panel operating time.

12 Claims, 3 Drawing Sheets

U.S. PATENT DOCUMENTS

Figure 2:
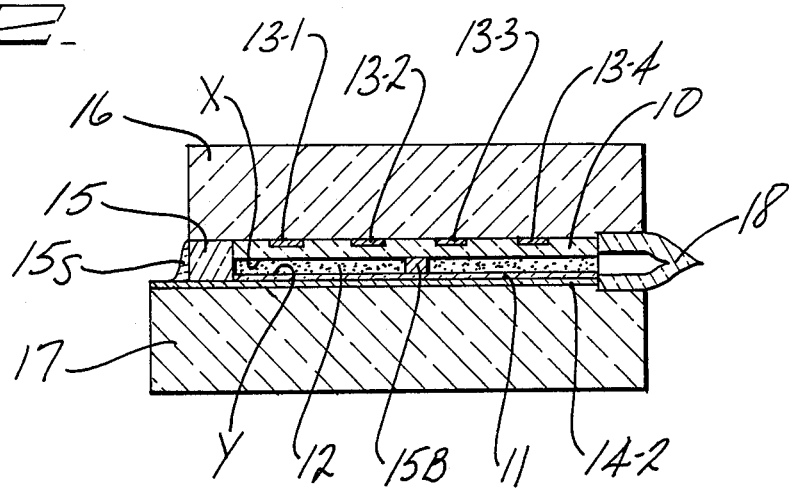

| | | | |
|---|---|---|---|
| 3,017,446 | 1/1962 | Goldsmid et al. | 136/5 |
| 3,019,136 | 1/1962 | Auffenorde et al. | 117/211 |
| 3,039,896 | 6/1962 | Cakenberghe et al. | 117/211 |
| 3,078,373 | 2/1963 | Wittenberg | 250/213 |
| 3,098,752 | 7/1963 | Mockrin et al. | 106/39 |
| 3,112,207 | 11/1963 | Mockrin et al. | 106/39 |
| 3,121,861 | 2/1964 | Alexander | 340/173 |
| 3,175,116 | 3/1965 | Feuer | 313/108 |
| 3,184,636 | 5/1965 | Dore et al. | 315/94 |
| 3,189,781 | 6/1965 | Lempert | 315/11 |
| 3,201,633 | 8/1965 | Lieb | 313/108 |
| 3,202,054 | 8/1965 | Mochel | 117/211 |
| 3,236,686 | 2/1966 | Schaefer | 117/222 |
| 3,242,374 | 3/1966 | Firth | 313/346 |
| 3,244,922 | 4/1966 | Wolfgang | 313/95 |
| 3,256,702 | 6/1966 | Henderson | 62/3 |
| 3,257,581 | 6/1966 | Lodge et al. | 315/169 |
| 3,264,074 | 8/1966 | Jones | 29/183.5 |
| 3,334,269 | 8/1967 | L'Heureux | 315/58 |
| 3,336,499 | 8/1967 | O'Meara | 313/188 |
| 3,350,598 | 10/1967 | Corbin et al. | 313/220 |
| 3,374,381 | 3/1968 | Albinak et al. | 313/108 |
| 3,377,494 | 4/1968 | Repsher | 313/109 |
| 3,377,498 | 4/1968 | Koury et al. | 313/221 |
| 3,404,032 | 10/1968 | Collins | 117/212 |
| 3,411,947 | 11/1968 | Block et al. | 117/215 |
| 3,434,817 | 3/1969 | Hazdra | 117/124 A |
| 3,440,477 | 4/1969 | Crowell et al. | 315/11 |
| 3,461,335 | 8/1969 | Lothaller | 313/226 |
| 3,465,196 | 9/1969 | Millis | 313/313 |
| 3,496,011 | 2/1970 | Crosby et al. | 117/69 |
| 3,499,167 | 3/1970 | Baker et al. | 313/220 |
| 3,503,763 | 3/1970 | Mills | 106/53 |
| 3,504,819 | 4/1970 | Veres | 220/2.1 |
| 3,509,407 | 4/1970 | Cullis, Jr. | 313/201 |
| 3,513,327 | 5/1970 | Johnson | 307/89 |
| 3,519,891 | 7/1970 | Leinkram | 317/101 |
| 3,551,721 | 12/1970 | Holz | 313/204 |
| 3,559,190 | 1/1971 | Bitzer | 315/169 |
| 3,562,737 | 2/1971 | Wiederhorn et al. | 340/325 |
| 3,573,531 | 4/1971 | Kerstetter et al. | 313/108 |
| 3,573,542 | 4/1971 | Mayer et al. | 315/169 |
| 3,597,667 | 3/1966 | Horn | 117/217 |
| 3,599,029 | 8/1971 | Martyny | 313/109 |
| 3,612,938 | 10/1971 | De Boer et al. | 315/169 R |
| 3,614,509 | 10/1971 | Willson | 313/201 |
| 3,614,511 | 10/1911 | Baker | 313/188 |
| 3,624,444 | 11/1971 | Berthold et al. | 313/44 |
| 3,627,577 | 12/1971 | Steidel | 117/227 |
| 3,631,291 | 12/1971 | Favreau | 313/345 |
| 3,634,719 | 1/1972 | Ernsthausen | 313/587 |
| 3,646,378 | 2/1972 | Goossens | 313/27 |
| 3,649,542 | 3/1972 | Hasebe et al. | 252/63.5 |
| 3,664,866 | 5/1972 | Manasevit | 117/201 |
| 3,675,088 | 7/1972 | Nagasawa | 317/234 R |
| 3,697,797 | 10/1972 | Freyhert et al. | 313/217 |
| 3,716,424 | 2/1973 | Schoolar | 148/175 |
| 3,716,742 | 2/1973 | Nakayama et al. | 313/182 |
| 3,723,977 | 3/1973 | Schaufele | 340/173 PL |
| 3,746,420 | 7/1973 | Baker et al. | 316/20 |
| 3,784,951 | 1/1974 | Steidel | 338/262 |
| 3,786,474 | 1/1974 | Miller | 315/169 |
| 3,789,470 | 2/1974 | Owaki et al. | 29/25.13 |
| 4,731,560 | 3/1988 | Ernsthausen | 313/587 |

MULTIPLE GASEOUS DISCHARGE DISPLAY/MEMORY PANEL HAVING IMPROVED OPERATING LIFE

RELATED APPLICATION

This application is a continuation of application Ser. No. 385,973 filed Aug. 6, 1973, now abandoned which is a continuation of copending U.S. patent application Ser. No. 61,842 filed Aug. 6, 1970, now abandoned.

THE INVENTION

This invention relates to novel multiple gas discharge display/memory panels which have an electrical memory and which are capable of producing a visual display or representation of data such as numerals, letters, television display, radar displays, binary words, etc. More particularly, this invention relates to novel gas discharge display/memory panels having substantially decreased and more uniform operating voltages; that is, operating voltages which are essentially stable as a function of panel operating time. As used herein, voltage is defined as any voltage required for operation of the panel including firing and sustaining voltages as well as any other voltages for manipulation of the discharge.

Multiple gas discharge display and/or memory panels of the type with which the present invention is concerned are characterized by an ionizable gaseous medium, usually a mixture of at least two gases at an appropriate gas pressure, in a thin gas chamber or space between a pair of opposed dielectric charge storage members which are backed by conductor (electrode) members, the conductor members backing each dielectric member being transversely oriented to define a plurality of discrete discharge volumes and constituting a discharge unit. In some prior art panels the discharge units are additionally defined by surrounding or confining physical structure such as by cells or apertures in perforated glass plates and the like so as to be physically isolated relative to other units. In either case, with or without the confining physical structure, charges (electrons, ions) produced upon ionization of the gas of a selected discharge unit, when proper alternating operating potentials are applied to selected conductors thereof, are collected upon the surfaces of the dielectric at specifically defined locations and constitute an electrical field opposing the electrical field which created them so as to terminate the discharge for the remainder of the half cycle and aid in the initiation of a discharge on a succeeding opposite half cycle of applied voltage, such charges as are stored constituting an electrical memory.

Thus, the dielectric layers prevent the passage of any conductive current from the conductor members to the gaseous medium and also serve as collecting surfaces for ionized gaseous medium charges (electrons, ions) during the alternate half cycles of the A.C. operating potentials, such charges collecting first on one elemental or discrete dielectric surface area and then on an opposing elemental or discrete dielectric surface area on alternate half cycles to constitute an electrical memory.

An example of a panel structure containing non-physically isolated or open discharge units is disclosed in U.S. Pat. No. 3,499,167 issued to Theodore C. Baker, et al.

An example of a panel containing physically isolated units is disclosed in the article by D. L. Bitzer and H. G. Slottow entitled "The Plasma Display Panel—A Digitally Addressable Display With Inherent Memory", Proceeding of the Fall Joint Computer Conference, IEEE, San Francisco, Calif., Nov. 1966, pages 541–547.

In the operation of the panel, a continuous volume of ionizable gas is confined between a pair of dielectric surfaces backed by conductor arrays forming matrix elements. The cross conductor arrays may be orthogonally related (but any other configuration of conductor arrays may be used) to define a plurality of opposed pairs of charge storage areas on the surfaces of the dielectric bounding or confining the gas. Thus, for a condcctor matrix having H rows and C columns the number of elemental discharge volumes will be the product $H \times C$ and the number of elemental or discrete areas will be twice the number of elemental discharge volumes.

The gas is one which produces light (if visual display is an objective) and a copious supply of charges (ions and electrons) during discharge. In an open cell Baker, et al. type panel, the gas pressure and the electric field are sufficient to laterally confine charges generated on discharge within elemental or discrete volumes of gas between opposed pairs of elemental or discrete dielectric areas within the perimeter of such areas, especially in a panel containing non-isolated units.

As described in the Baker, et al. patent, the space between the dielectric surfaces occupied by the gas is such as to permit photons generated on discharge in a selected discrete or elemental volume of gas to pass freely through the gas space and strike surface areas of dielectric remote from the selected discrete volumes, such remote, photon struck dielectric surface areas thereby emitting electrons so as to condition other and more remote elemental volumes for discharges at a uniform applied potential.

With respect to the memory function of a given discharge panel, the allowable distance or spacing between the dielectric surfaces depends, inter alia, on the frequency of the alternating current supply, the distance typically being greater for lower frequencies.

While the prior art does disclose gaseous discharge devices having externally positioned electrodes for initiating a gaseous discharge, sometimes called "electrodeless discharges", such prior art devices utilize frequencies and spacings or discharge volumes and operating pressures such that although discharges are initiated in the gaseous medium, such discharges are ineffective or not utilized for charge generation and storage in the manner of the present invention.

The term "memory margin" is defined herein as $$M.\,M. = \frac{V_f - V_s}{V_s}$$

where $V_f$ is the magnitude of the applied voltage at which a discharge is initiated in a discrete conditioned (as explained in the aforementioned Baker, et al. patent) volume of gas defined by common areas of overlapping conductors and $V_s$ is the magnitude of the minimum applied periodic alternating voltage sufficient to sustain discharges once initiated. It will be understood that basic electrical phenomena utilized in this invention is the generation of charges (ions and electrons) alternately storable at pairs of opposed or facing discrete points or areas on a pair of dielectric surfaces backed by conductors connected to a source of operating potential. Such stored charges result in an electrical field opposing the field produced by the applied potential that created them and hence operate to terminate ionization in the elemental gas volume between opposed or facing discrete points or areas of dielectric surface. The term "sustain a discharge" means producing a sequence of momentary discharges, one discharge for each half cycle of applied alternating sustaining voltage, once the elemental gas volume has been fired, to maintain alternate storing of charges at pairs of opposed discrete area on the dielectric surfaces.

Figure 1:
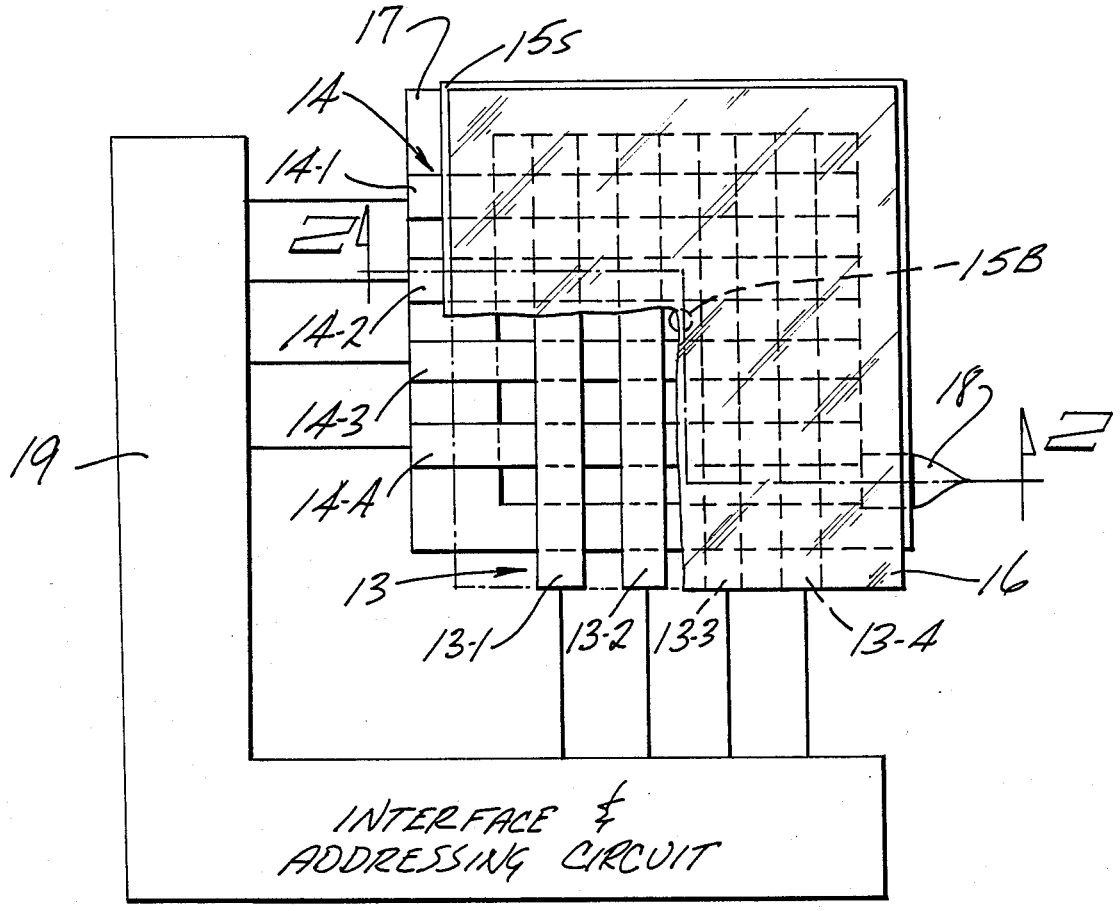
Figure 3:
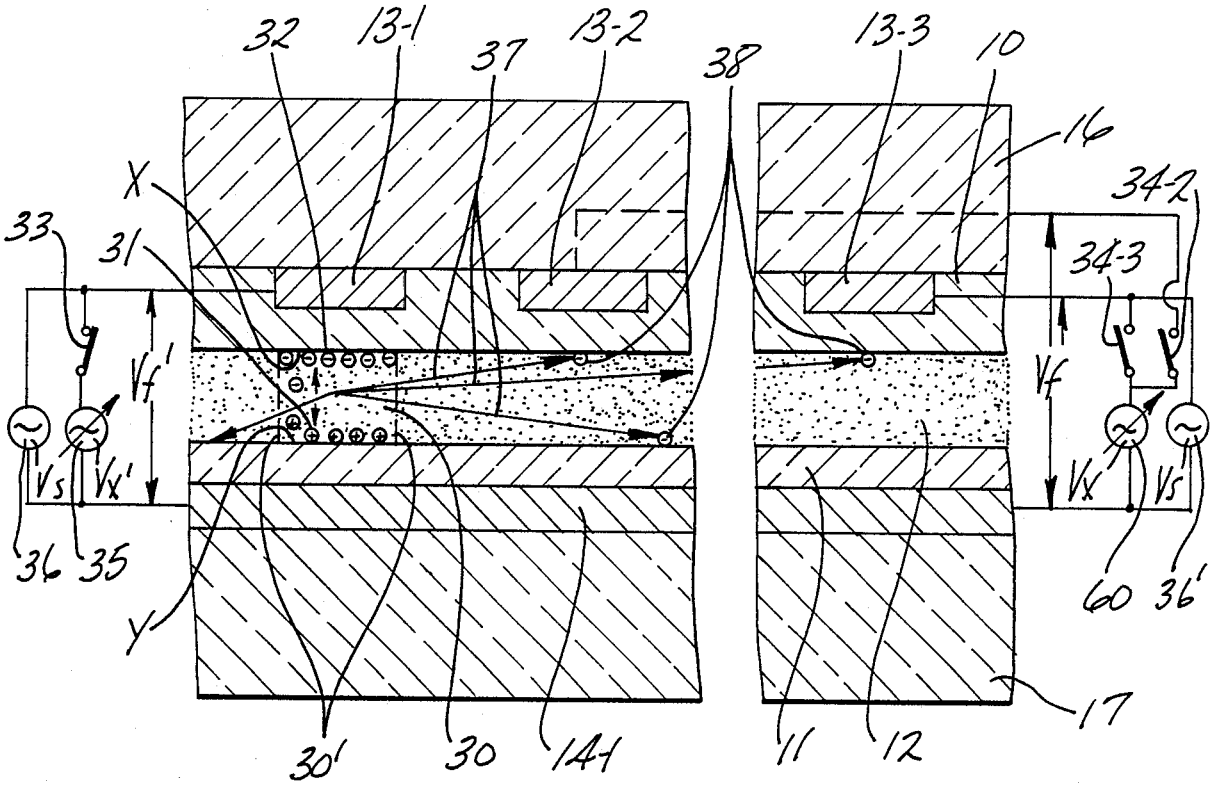
Figure 4:
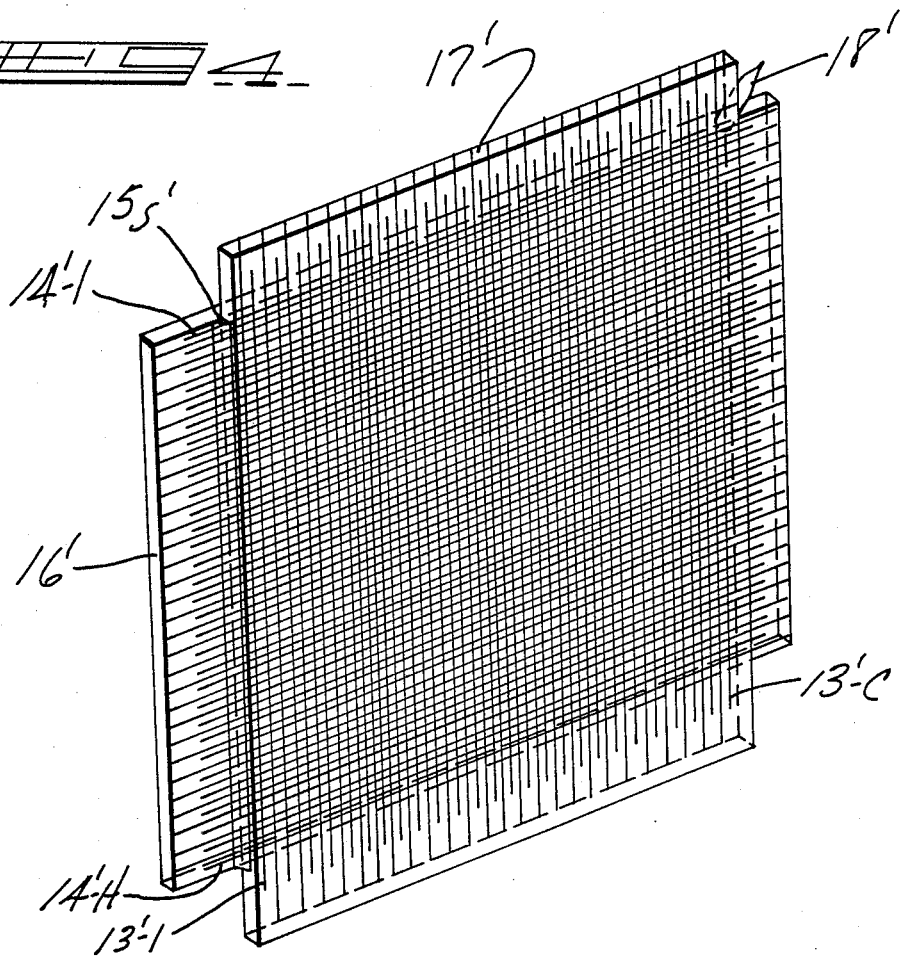
Figure 5:
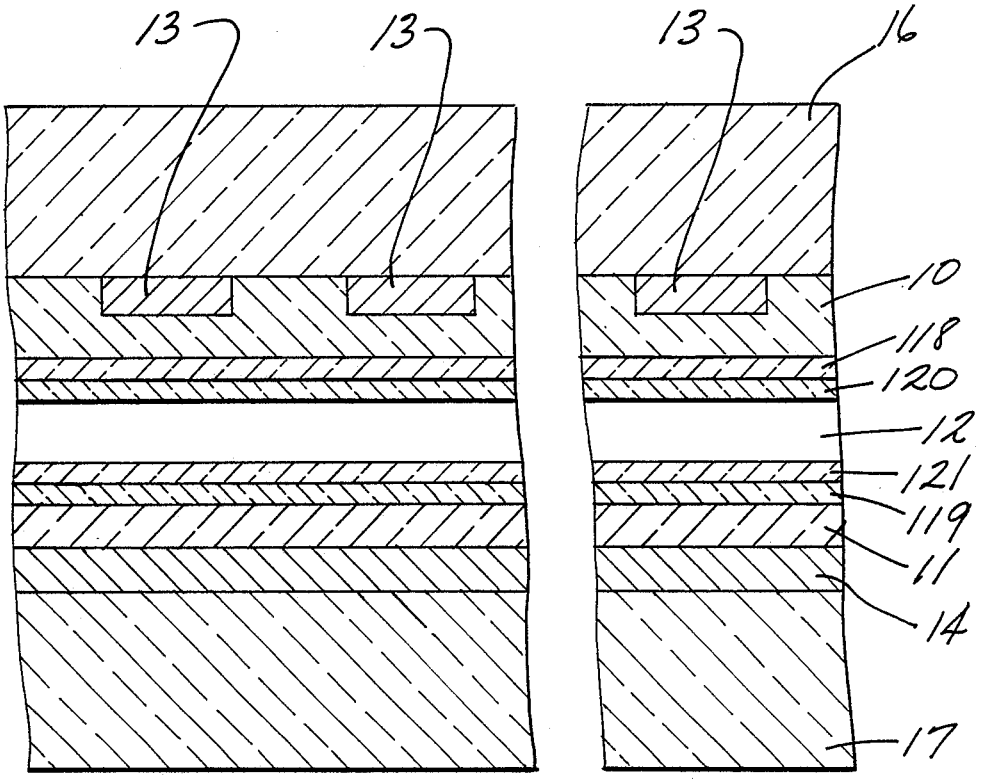

FIG. 1 is a partially cut-away plan view of the type of gaseous discharge display-memory panel which may incorporate the invention as connected to a diagrammatically illustrated source of operating ptentials, FIG. 2 is a cross-sectional view (enlarged, but not to proportional scale since the thickness of the gas volume, dielectric members and conductor arrays have been enlarged for purposes of illustration) taken on lines 2—2 of FIG. 1, FIG. 3 is an explanatory partial cross-sectional view similar to FIG. 2 (enlarged, but not to proportional scale), FIG. 4 is an isometric view of the type of a larger gaseous discharge display/memory panel which may incorporate the invention, and FIG. 5 is a partial cross-sectional view similar to FIG. 3 showing the incorporation of the present invention.

FIGS. 1–4 and the following description of these drawings are from the previously mentioned Baker, et al. U.S. Pat. No. 3,499,167.

The invention utilizes a pair of dielectric films or coatings 10 and 11 separated by a thin layer or volume of a gaseous discharge medium 12, said medium 12 producing a copious supply of charges (ions and electrons) which are alternately collectable on the surfaces of the dielectric members at opposed or facing elemental or discrete areas X and Y defined by the conductor matrix on non-gas-contacting sides of the dielectric members, each dielectric member presenting large open surface areas and a plurality of pairs of elemental X and Y areas. While the electrically operative structural members such as the dielectric members 10 and 11 and conductor matrixes 13 and 14 are all relatively thin (being exaggerated in thickness in the drawings) they are formed on and supported by rigid nonconductive support members 16 and 17 respectively.

Preferably, one or both of nonconductive support members 16 and 17 pass light produced by discharge in the elemental gas volumes. Preferably, they are transparent glass members and these members essentially define the overall thickness and strength of the panel. For example, the thickness of gas layer 12 as determined by spacer 15 is under 10 mils and preferably about 5 to 6 mils, dielectric layers 10 and 11 (over the conductors at the elemental or discrete X and Y areas) is between 1 and 2 mils thick, and conductors 13 and 14 about 8,000 angstroms thick (tin oxide). However, supoort members 16 and 17 are much thicker (particularly larger panels) so as to provide as much ruggedness as may be desired to compensate for stresses in the panel. Support members 16 and 17 also serve as heat sinks for heat generated by discharges and thus minimize the effect of temperature on operation of the device. If it is desired that only the memory function be utilized, then none of the members need be transparent to light although for purposes described later herein it is preferred that one of the support members and members formed thereon be transparent to or pass ultraviolet radiation.

Except for being nonconductive or good insulators the electrical properties of support members 16 and 17 are not critical. The main function of support members 16 and 17 is to provide mechanical support and strength for the entire panel, particularly with respect to pressure differential acting on the panel and thermal shock. As noted earlier, they should have thermal expansion characteristics substantially matching the thermal expansion characteristics of dielectric layers 10 and 11. Ordinary ¼" commercial grade soda lime plate glasses have been used for this purpose. Other glasses such as low expansion glasses or transparent devitrified glass can be used provided they can withstand processing and have expansion characteristics substantially matching expansion characteristics of the dielectric coatings 10 and 11. For given pressure differentials and thickness of plates the stress and deflection of plates may be determined by following standard stress and strain formulas (see R. J. Roark, *Formulas for Stress and Strain,* McGraw-Hill, 1954).

Spacer 15 may be made of the same glass material as dielectric films 10 and 11 and may be an integral rib formed on one of the dielectric members and fused to the other members to form a bakeable hermetic seal enclosing and confining the ionizable gas volume 12. However, a separate final hermetic seal may be effected by a high strength devitrified glass sealant 15S. Tubulation 18 is provided for exhausting the space between dielectric members 10 and 11 and filling that space with the volume of ionizable gas. For large panels small bead-like solder glass spacers such as shown at 15B may be located between conductor intersections and fused to dielectric members 10 and 11 to aid in withstanding stress on the panel and maintain uniformity of thickness of gas volume 12.

Conductor arrays 13 and 14 may be formed on support members 16 and 17 by a number of well-known processes, such as photoetching, vacuum deposition, stencil screening, etc. In the panel shown in FIG. 4, the center-to-center spacing of conductors in the respective arrays is about 30 mils. Transparent or semi-transparent conductive material such as tin oxide, gold or aluminum can be used to form the conductor arrays and should have a resistance less than 3000 ohms per line. It is important to select a conductor material that is not attached during processing by the dielectric material.

It will be appreciated that conductor arrays 13 and 14 may be wires or filaments of copper, gold, silver or aluminum or any other conductive metal or material. For example, 1 mil wire filaments are commercially available and may be used in the invention. However, formed in situ conductor arrays are preferred since they may be more easily and uniformly placed on and adhered to the support plates 16 and 17.

Dielectric layer members 10 and 11 are formed of an inorganic material and are preferably formed in situ as adherent film or coating which is not chemically or physically effected during bake-out of the panel. One such material is a solder glass such as Kimble SG-68 manufactured by and commercially available from the assignee of the present invention.

This glass has thermal expansion characteristics substantially matching the thermal expansion characteristics of certain soda-lime glasses, and can be used as the dielectric layer when the support members 16 and 17 are soda-lime glass plates. Dielectric layers 10 and 11 must be smooth and have a dielectric strength of about 1000 v. and be electrically homogeneous on a microscopic scale (e.g., no cracks, bubbles, crystals, dirt, surface films, etc.). In addition, the surfaces of dielectric layers 10 and 11 should be good photoemitters of electrons in a baked out condition. However, a supply of free electrons for conditioning gas 12 for the ionization process may be provided by inclusion of a radioactive material within the glass or gas space. A preferred range of thickness of dielectric layer 10 and 11 overlying the conductor arrays 13 and 14 is between 1 and 2 mils. Of course, for an optical display at least one of dielectric layers 10 and 11 should pass light generated on discharge and be transparent or translucent and, preferably, both layers are optically transparent.

The preferred spacing between surfaces of the dielectric films is about 5 to 6 mils with conductor arrays 13 and 14 having center-to-center spacing of about 30 mils.

The ends of conductors 14-1 . . . 14-4 and support member 17 extend beyond the enclosed gas volume 12 and are exposed for the purpose of making electrical connection to interface and addressing circuitry 19. Likewise, the ends of conductors 13-1 . . . 13-4 on support member 16 extend beyond the enclosed gas volume 12 and are exposed for the purpose of making electrical connection to interface and addressing circuitry 19.

As in known display systems, the interface and addressing circuitry or system 19 may be relatively inexpensive line scan systems or the somewhat more epensive high speed random access systems. However, it is to be noted that a lower amplitude of operating potentials helps to reduce problems associated with the interface circuitry between the addressing system and the display/memory panel, per se. Thus, by providing a panel having greater uniformity in the discharge characteristics throughout the panel, tolerances and operating characteristics of the panel with which the interfacing circuitry cooperate, are made less rigid.

One mode of initiating operation of the panel will be described with reference to FIG. 3, which illustrates the condition of one elemental gas volume 30 having an elemental cross-sectional area and volume which is quite small relative to the entire volume and cross-sectional area of gas 12. The cross-sectional area of volume 30 is defined by the overlapping common elemental areas of the conductor arrays and the volume is equal to the product of the distance between the dielectric surfaces and the elemental area. It is apparent that if the conductor arrays are uniform and linear and are orthogonally (at right angles to each other) related each of elemental areas X and Y will be squares and if conductors of one conductor array are wider than conductors of the other conductor array said areas will be rectangles. If the conductor arrays are at transverse angles relative to each other, other than 90°, the areas will be diamond shaped so that the cross-sectional shape of each volume is determined solely in the first instance by the shape of the common area of overlap between conductors in the conductor arrays 13 and 14. The dotted lines 30' are imaginary lines to show a boundary of one elemental volume about the center of which each elemental discharge takes place. As described earlier herein, it is known that the cross-sectional area of the discharge in a gas is affected by, inter alia, the pressure of the gas, such that, if desired, the discharge may even be constricted to within an area smaller than the area of conductor overlap. By utilization of this phenomena, the light production may be confined or resolved substantially to the area of the elemental cross-sectional area defined by conductor overlap. Moreover, by operating at such pressure charges (ions and electrons) produced on discharge are laterally confined so as to not materially affect operation of adjacent elemental discharge volumes.

In the instant shown in FIG. 3, a conditioning discharge about the center of elemental volume 30 has been initiated by application to conductor 13-1 and conductor 14-1 firing potential $V_x'$ as derived from a source 35 of variable phase, for example, and source 36 of sustaining potential $V_s$ (which may be a sine wave, for example). The potential $V_x'$ is added to the sustaining potential $V_s$ as sustaining potential $V_s$ increases in magnitude to initiate the conditioning discharge about the center of elemental volume 30 shown in FIG. 3. There the phase of the source 35 of potential $V_x'$ has been adjusted into adding relation to the alternating voltage from the source 36 of sustaining voltage $V_s$ to provide a voltage $V_f'$, when switch 33 has been closed, to conductors 13-1 and 14-1 defining elementary gas volume 30 sufficient (in time and/or magnitude) to produce a light generating discharge centered about discrete elemental gas volume 30. At the instant shown, since conductor 13-1 is positive, electrons 32 have collected on and are moving to an elemental area of dielectric member 10 substantially corresponding to the area of elemental gas volume 30 and the less mobile positive ions 31 are beginning to collect on the opposed elemental area of dielectric member 11 since it is negative. As these charges build up, they constitute a back voltage opposed to the voltage applied to conduttors 13-1 and 14-1 and serve to terminate the discharge in elemental gas volume 30 for the remainder of a half cycle.

During the discharge about the center of elemental gas volume 30, photons are produced which are free to move or pass through gas medium 12, as indicated by arrows 37, to strike or impact remote surface areas of photoemissive dielectric members 10 and 11, causing such remote areas to release electrons 39. Electrons 38 are, in effect, free electrons in gas medium 12 and condition each other discrete elemental gas volume for operation at a lower firing potential $V_f$ which is lower in magnitude than the firing potential $V_f'$ for the initial discharge about the center of elemental volume 30 and this voltage is substantially uniform for each other elemental gas volume.

Thus, elimination of physical obstructions or barriers between discrete elemental volumes, permits photons to travel via the space occupied by the gas medium 12 to impact remote surface areas of dielectric members 10 and 11 and provides a mechanism for supplying free electrons to all elemental gas volumes, thereby conditioning all discrete elemental gas volumes for subsequent discharges, respectively, at a uniform lower applied potential. While in FIG. 3 a single elemental volume 30 is shown, it will be appreciated that an entire row or column) of elemental gas volumes may be maintained in a "fired" condition during normal operation of the device with the light produced thereby being masked or blocked off from the normal viewing area and not used for display purposes. It can be expected that in some applications there will always be at least one elemental volume in a "fired" condition and producing light in a panel, and in such applications it is not necessary to provide separate discharge or generation of photons for purposes described earlier.

However, as described earlier, the entire gas volume can be conditioned for operation at uniform firing potentials by use of external or internal radiation so that there will be no need for a separate source of higher potential for initiating an initial discharge. Thus, by radiating the panel with ultraviolet radiation or by inclusion of a radioactive material within the glass materials or gas space, all discharge volumes can be operated at uniform potentials from addressing and interface circuit 19.

Since each discharge is terminated upon a build up or storage of charges at opposed pairs of elemental areas, the light produced is likewise terminated. In fact, light production lasts for only a small fraction of a half cycle of applied alternating potential and depending on design parameters, is in the nanosecond range.

After the initial firing or discharge of discrete elemental gas volume 30 by a firing potential $V_f$, switch 33 may be opened so that only the sustaining voltage $V_s$ from source 36 is applied to conductors 13-1 and 14-1. Due to the storage of charges (e.g., the memory) at the opposed elemental areas X and Y, the elemental gas volume 30 will discharge again at or near the peak of negative half cycles of sustaining voltage $V_s$ to again produce a momentary pulse of light. At this time, due to reversal of field direction, electrons 32 will collect on and be stored on elemental surface area Y of dielectric ember 11 and positives ions 31 will collect and be stored on elemental surface area X of dielectric member 10. After a few cycles of sustaining voltage $V_s$, the times of discharges become symmetrically located with respect to the wave form of sustaining voltage $V_s$. At remote elemental volumes, as, for example, the elemental volumes defined by conductor 14-1 with conductors 13-2 and 13-3, a uniform magnitude or potential $V_x$ from source 60 is selectively added by one or both of switches 34 2 or 34-3 to the sustaining voltage $V_s$, shown as 36', to fire one or both of these elemental discharge volumes. Due to the presence of free electrons produced as a result of the discharge centered about elemental volume 30, each of these remote discrete elemental volumes have been conditioned for operation at uniform firing potential $V_f$.

In order to turn "off" an elemental gas volume (i.e., terminate a sequence of discharge representing the "on" state), the sustaining voltage may be removed. However, since this would also turn "off" other elemental volumes along a row or column, it is preferred that the volumes be selectively turned "off" by application to selected "on" elemental volumes a voltage which can neutralize the charges stored at the pairs of opposed elemental areas.

This can be accomplished in a number of ways, as for example, varying the phase or time position of the potential from source 60 to where that voltage combined with the potential from source 36' falls substantially below the sustaining voltage.

It is apparent that the plates 16–17 need not be flat but may be curved, curvature of facing surfaces of each plate being complementary to each other. While the preferred conductor arrangement is of the crossed grid type as shown herein, it is likewise apparent that where an infinite variety of two dimensional display patterns are not necessary, as where specific standardized visual shapes (e.g., numerals, letters, words, etc.) are to be formed and image resolution is not critical, the conductors may be shaped accordingly.

The device shown in FIG. 4 is a panel having a large number of elemental volumes similar to elemental volume 30 (FIG. 3). In this case more room is provided to make electrical connection to the conductor arrays 13' and 14', respectively, by extending the surfaces of support members 16' and 17' beyond seal 15S', alternate conductors being extended on alternate sides. Conductor arrays 13' and 14' as well as support members 16' and 17' are transparent. The dielectric coatings are not shown in FIG. 4 but are likewise transparent so that the panel may be viewed from either side.

In accordance with this invention and with reference to FIG. 5 it has been surprisingly discovered that the gaseous discharge panel voltage uniformity or stability as a function of gaseous discharge panel operating time may be significantly enhanced and improved by applying an oxide layer 118, 119 selected from aluminum, titanium, zirconium, hafnium, and silicon to the surface of the dielectric material 10, 11. More particularly, at least one oxide of Al, Ti, Zr, Hf, and Si is applied to the dielectric material charge storage surface so as to provide gaseous discharge panel operating voltages which do not significantly vary or substantially change over a given period of panel operating time and thereby increase the effective and useful operating life of the gaseous discharge panel.

In one embodiment hereof, the selected metal or metalloid oxide is applied directly to the surface of the dielectric material.

In still another embodiment hereof, the oxide is formed in situ on the dielectric surface, e.g., by applying the elemental metal or metalloid (or a source thereof) to the dielectric surface followed by oxidation. One such in situ process comprises applying metal or metalloid melt to the dielectric followed by oxidation of the melt during the cooling thereof. Another in situ process comprises applying an oxidizable source of the elemental metal or metalloid to the surface. Typical of such sources include minerals and/or compounds containing the element, especially those organometals or organometalloids which are readily heat decomposed or pyrolyzed.

The selected metal or metalloid oxide or a source thereof is applied to the dielectric surface by any convenient means including not by way of limitation vapor deposition; vacuum deposition; chemical vapor deposition wet spraying upon the surface a mixture or solution of the oxide suspended or dissolved in a liquid followed by evaporation of the liquid; dry spraying of the oxide upon the surface; electron beam evaporation; plasma flame and/or arc spraying and/or deposition; and sputtering target techniques.

The selected oxide is applied to (or formed on) the dielectric surface as a very thin film or layer, the thickness and amount of such oxide film or layer being sufficient to provide stable panel operating voltages as a function of panel operating time.

More especially, the selected metal or metalloid oxide is applied to the dielectric material surface as a thin film or layer having a thickness sufficient to be impervious to any potentially migrating ions from the dielectric material, e.g., usually at least about 200 angstrom units with a typical maximum or upper limit of about 1 micron (10,000 angstrom units).

As used herein, the terms "film or layer" are intended be all inclusive of other similar terms such as deposit, coating, finish, spread, covering, etc.

In the fabrication of a gaseous discharge panel (see FIG. 5), the dielectric material 10, 11 is typically applied to and cured on the surface of a supporting glass substrate or base 16, 17 to which the electrode or conductor element 13, 14 have been previously applied. The glass substrate may be of any suitable composition such as a soda lime glass composition. Two glass substrates containing electrodes and cured dielectric are then appropriately heat sealed together so as to form a panel.

In the preferred practice of this invention, the selected metal or metalloid oxide layer 118, 119 applied to the surface of the cured dielectric 10, 11 before the panel heat sealing cycle.

Depending upon the specific metal or metalloid oxide or combinations thereof utilized, the practice of this invention has been found to be especially beneficial over given periods of panel operating time. Best results are typically realized after appropriate aging of the panel, the required amount of aging being a function of the oxides used. Panel aging is defined as the accumulated total operating time for the panel.

The following examples are intended to illustrate some of the best embodiments contemplated by the inventors in the practice of this invention.

EXAMPLE I

A layer of aluminum oxide ($Al_2O_3$) was deposited to a relatively uniform thickness of about 600 angstrom units on the respective exposed surfaces of two cured dielectric material layers, each dielectric layer having been previously applied and cured onto (electrodes containing) glass substrates.

The aluminum oxide was deposited by means of an electron beam evaporation technique. The dielectric composition was a lead borosilicate consisting of 73.3% by weight PbO, 13.4% by weight $B_2O_3$, and 13.3% by weight $SiO_2$. The glass substrates were of a soda lime composition containing about 73% by weight $SiO_2$, about 13% by weight $Na_2O$, about 10% by weight CaO, about 3% by weight MgO, about 1% by weight $Al_2O_3$, and small amounts (less than 1%) of $Fe_2O_3$, $K_2O$, $As_2O_3$, and $Cr_3O_3$. The electrode lines or conductor arrays were of hanovia gold.

The two substrates were heat sealed together (using a standard solder glass) so as to form a gaseous discharge panel of the open cell Baker, et al. kind. After an appropriate vacuum process, the panel was filled with an inert ionizable gas consisting of 99.9% atoms of neon and 0.1% atoms of argon. After aging of the panel for about 50 hours during which time the operating voltage increased by about 18 volts the voltage leveled off with a change of only −2 volts over the next 500 hours of panel operating time.

EXAMPLE II

The panel fabrication of Example I was repeated using titanium oxide ($TiO_2$) instead of aluminum oxide ($Al_2O_3$). After aging of the panel for about 30 hours during which time the operating voltage increased by about 8 volts, the voltage leveled off with no change being measured over the next 500 hours of panel operating time.

The foregoing examples illustrate that when a layer of oxide is applied to the dielectric surface in accordance with this invention, the resulting fabricated gaseous discharge panel has, after appropriate aging, more stable panel operating voltages as a function of operating time and therefore increased panel operation life.

I claim:

1. An article of manufacture for a gaseous discharge display/memory device consisting of a dielectric body having at least one electrode on one side thereof and on the opposite side thereof a coating consisting of at least one oxide of Al, Ti, Zr, Hf, or Si in an amount sufficient to provide gaseous discharge operating voltages in the device which do not substantially change over a given period of operating time.

2. The invention of claim 1 wherein said coating provides no continuous electrically conductive path on the surface of said dielectric body.

3. The invention of claim 2 wherein said dielectric body further comprises a glass substrate contiguous to said electrode and said one side of said dielectric body.

4. The invention of claim 3 wherein said glass substrate is a soda lime glass comprising about 73% by weight $SiO_2$, about 13% by weight $Na_2O$, about 10% by weight CaO, about 3% by weight MgO, about 1% by weight $Al_2O_3$ and less than 1% by weight $Fe_2O_3$, $K_2O$, $As_2O_3$, and $Cr_2O_3$.

5. The invention of claim 3 wherein said dielectric body comprises an array of electrodes on said one side thereof.

6. The invention of claim 5 wherein the dielectric body is coated with an oxide thickness of at least about 200 angstrom units.

7. The invention of claim 6 wherein the oxide thickness ranges from about 200 angstrom units up to about 10,000 angstrom units.

8. The invention of claim 7 wherein the dielectric body comprises a lead borosilicate glass.

9. The invention of claim 8 wherein the lead borosilicate glass contains about 73.3% by weight PbO, 13.4% by weight $B_2O_3$ and 13.3% by weight $SiO_2$.

10. An article of manufacture for a display device utilizing gas discharge and comprising a dielectric material member having a pair of oppositely facing surfaces and comprising heavy metallic elements, at least one electrode on one of said surfaces and, on the opposite surface thereof, a layer of a composition selected from the group consisting of oxides of aluminum, titanium, zirconium, hafnium and silicon for providing operating voltages in the display device which do not significantly vary or substantially change during long term operation of the display device and thereby increase the effective and useful operating life of the display device.

11. An article of manufacture according to claim 10 wherein said at least one electrode comprises an array of parallel-like electrical conductor members.

12. An article of manufacture for a display device utilizing gas discharge and consisting of a dielectric material member having a pair of oppositely facing surfaces and comprising heavy metallic elements, a group of electrodes on one of said surfaces, and a protection layer consisting of at least one oxide of aluminum, titanium, zirconium, hafnium and silicon on the other of said surfaces for providing operating voltages in the display device which do not significantly vary or substantially change during long term operation of the display device and thereby increase the effective and useful operating life of the display device.

* * * * *